US012662955B2

(12) United States Patent
Gaiser et al.

(10) Patent No.: US 12,662,955 B2
(45) Date of Patent: Jun. 23, 2026

(54) CATALYTIC HEATER FOR AN EXHAUST GAS SYSTEM OF AN INTERNAL COMBUSTION ENGINE, EXHAUST GAS SYSTEM AND METHOD OF OPERATING AN EXHAUST GAS SYSTEM

(71) Applicant: Purem GmbH, Neunkirchen (DE)

(72) Inventors: Gerd Gaiser, Reutlingen (DE); Bernd Weller, Durlangen (DE); Tobias Lehr, Esslingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 18/981,203

(22) Filed: Dec. 13, 2024

(65) Prior Publication Data

US 2025/0198318 A1 Jun. 19, 2025

(30) Foreign Application Priority Data

Dec. 15, 2023 (DE) ..... 10 2023 135 267.9

(51) Int. Cl.

| | |
|---|---|
| ***F01N 3/20*** | (2006.01) |
| ***F01N 3/10*** | (2006.01) |
| ***F01N 13/00*** | (2010.01) |

(52) U.S. Cl.

CPC ..... *F01N 3/2013* (2013.01); *F01N 3/106* (2013.01); *F01N 13/009* (2014.06); *F01N 3/2066* (2013.01); *F01N 2240/16* (2013.01); *F01N 2250/02* (2013.01)

(58) Field of Classification Search

CPC ..... F01N 13/009; F01N 13/0097; F01N 2250/02; F01N 2260/04; F01N 3/0253; F01N 3/2013; F01N 3/2026; F01N 3/30; F01N 3/36; F02B 3/06

See application file for complete search history.

(56) References Cited

U.S. PATENT DOCUMENTS

| | | | | |
|---|---|---|---|---|
| 5,839,273 | A * | 11/1998 | Maus | F01N 13/0097 60/284 |
| 2013/0004374 | A1 | 1/2013 | Kanba et al. | |
| 2014/0000241 | A1 | 1/2014 | Baier et al. | |
| 2015/0027104 | A1* | 1/2015 | Bush | F01N 3/0253 60/274 |
| 2018/0142599 | A1* | 5/2018 | Pannuzzo | B01D 46/0027 |

FOREIGN PATENT DOCUMENTS

| | | | | |
|---|---|---|---|---|
| CN | 102966412 | A * | 3/2013 | F01N 3/2013 |
| DE | 43 40 742 | A1 | 6/1995 | |
| DE | 103 44 216 | A1 | 5/2005 | |
| DE | 10 2005 013 707 | A1 | 9/2006 | |
| DE | 102018122875 | A1 * | 3/2020 | F01N 3/2066 |
| JP | 2014-514490 | A | 6/2014 | |
| WO | 2011/111118 | A1 | 6/2013 | |

OTHER PUBLICATIONS

English Translation of DE 102018122875 (Year: 2018).*
English Translation of CN 102966412 (Year: 2013).*

* cited by examiner

*Primary Examiner* — Anthony Ayala Delgado
(74) *Attorney, Agent, or Firm* — Walter Ottesen, P.A.

(57) ABSTRACT

A catalytic heater for an exhaust gas system of an internal combustion engine includes at least one electrically excitable heating element, a hydrocarbon release arrangement for release of liquid hydrocarbon toward the at least one electrically excitable heating element, and an oxidation catalyst arrangement for oxidation of hydrocarbon heated at the at least one electrically excitable heating element.

21 Claims, 2 Drawing Sheets

CATALYTIC HEATER FOR AN EXHAUST GAS SYSTEM OF AN INTERNAL COMBUSTION ENGINE, EXHAUST GAS SYSTEM AND METHOD OF OPERATING AN EXHAUST GAS SYSTEM

CROSS-REFERENCE TO RELATED APPLICATIONS

This application claims priority of German patent application no. 10 2023 135 267.9, filed Dec. 15, 2023, the entire content of which is incorporated herein by reference.

TECHNICAL FIELD

The present disclosure relates to a catalytic heater for an exhaust gas system of an internal combustion engine, for example in a vehicle, and to an exhaust gas system equipped with such a catalytic heater and to a method of operating such an exhaust gas system.

BACKGROUND

In order, in the startup of an internal combustion engine in a vehicle, to reduce the period of time during which the pollutant content in the exhaust gas of the internal combustion engine essentially cannot be reduced because the temperature of exhaust gas treatment assemblies provided in an exhaust gas system, for example catalytic converters, is too low, it is known that an electric heater can be used, which generates heat on application of an electrical voltage and transfers it to the exhaust gas emitted by the internal combustion engine. The exhaust gas that has been heated further in this way leads to faster heating of the exhaust gas treatment assemblies positioned downstream of such a heater and hence to shortening of the period of time before commencement of efficient exhaust gas treatment after startup of the internal combustion engine.

SUMMARY

It is an object of the present disclosure to provide a heater for an exhaust gas system of an internal combustion engine, an exhaust gas system equipped with such a heater, and a method of operating such an exhaust gas system, with which efficient heating of components of the exhaust gas system is achieved with reduced energy use.

In a first aspect of the present disclosure, this object is achieved by a catalytic heater for an exhaust gas system of an internal combustion engine, including:

- at least one electrically excitable heating element,
- a hydrocarbon release arrangement for release of liquid hydrocarbon toward the at least one electrically excitable heating element,
- an oxidation catalyst arrangement for oxidation of hydrocarbon heated at the at least one electrically excitable heating element.

The catalytic heater constructed in accordance with the disclosure makes it possible to generate a majority of the heat to be transferred to the exhaust gas flowing within an exhaust gas system or to components of the exhaust gas system not by the electrical excitation of the at least one heating element but by the catalytic oxidation and the energy released. This leads firstly to a reduction in the load on an onboard voltage system of a vehicle, and secondly results in distinctly faster and more intense heating of the system regions to be conditioned for operation of an internal combustion engine or an exhaust gas system, for example catalytic converters.

In order to be able to provide a large surface area for the catalytic oxidation of the hydrocarbon to be conducted in the catalytic heater, the oxidation catalyst arrangement may include an oxidation catalyst block disposed on an outflow side of the at least one electrically excitable heating element for uptake and oxidation of hydrocarbon evaporated at the at least one electrically excitable heating element.

For efficient exploitation of the heat released at the at least one electrically excitable heating element, it is proposed that the oxidation catalyst arrangement include an oxidation catalyst material coating of the at least one electrically excitable heating element. The oxidation catalyst material coating can thus be brought very rapidly to an operating temperature required for performance of a catalytic oxidation of the hydrocarbon by direct physical contact and the conduction of heat thus enabled, even at comparatively low ambient temperatures.

In a further aspect of the present disclosure, the object is achieved by an exhaust gas system for an internal combustion engine, including at least one exhaust gas treatment assembly and, downstream of the at least one exhaust gas treatment assembly with regard to an exhaust gas flow direction, a catalytic heater constructed in accordance with the disclosure.

The at least one exhaust gas treatment assembly may include a first exhaust gas treatment assembly having an oxidation catalyst or/and a particulate filter. Depending on the type of internal combustion engine being used in conjunction with the exhaust gas system, that is, diesel engine or gasoline engine, and hence also the type of hydrocarbon used in the catalytic heater, the oxidation catalyst may be configured either as a diesel oxidation catalytic converter or as a three-way catalytic converter.

For even more efficient exhaust gas cleaning, especially in the case of configuration of the internal combustion engine as a diesel engine, the at least one exhaust gas treatment assembly may include a second exhaust gas treatment assembly having an SCR catalyst.

In this case, the first exhaust gas treatment assembly may be disposed upstream with respect to the second exhaust gas treatment assembly in the exhaust gas flow direction.

The catalytic heater may be disposed downstream of an exhaust gas turbocharger, for example, in the exhaust gas flow direction. An increased reduction in the nitrogen oxide content in the exhaust gas emitted from the internal combustion engine can be achieved when the catalytic heater is disposed downstream of a third exhaust gas treatment assembly in the exhaust gas flow direction and, for example, the third exhaust gas treatment assembly includes an SCR catalyst.

When operation of the catalytic heater is no longer required in the case of a sufficiently heated exhaust gas system, in order to compensate for any elevated flow resistance of the exhaust gas system unavoidably introduced thereby, it is proposed that an electively blockable bypass flow pathway be provided parallel to the catalytic heater.

Depending on the type of vehicle in which the exhaust gas system is to be integrated,

- the catalytic heater may be disposed in an exhaust gas system section to be positioned such that it runs downward in a height direction or/and laterally away from an internal combustion engine, or the catalytic heater may be disposed in an exhaust gas system section to be positioned such that it runs beneath a vehicle underbody or in a lateral region of a vehicle.

In a further aspect of the present disclosure, the object stated at the outset is achieved by a method of operating an exhaust gas system constructed in accordance with the disclosure, in which method the at least one electrically excitable heating element of the catalytic heater is operated such that liquid hydrocarbon meeting a surface of the at least one electrically excitable heating element is heated and is oxidized over the oxidation catalyst arrangement to generate heat.

In order to ensure that the hydrocarbon injected in the direction toward the at least one electrically excitable heating element is converted essentially completely by the catalytic oxidation and, therefore, emission of nonoxidized hydrocarbon to the environment is avoided, it is proposed that the injection of hydrocarbon toward the at least one electrically excitable heating element be started when, after commencement of the excitation of the at least one electrically excitable heating element, the oxidation catalyst arrangement has a predetermined temperature, preferably a temperature that permits catalytic oxidation of hydrocarbon over the oxidation catalyst arrangement, or/and after a predetermined period of time has passed since commencement of the excitation of the at least one electrically excitable heating element.

The period of time during which the exhaust gas emitted by an internal combustion engine cannot be treated efficiently, if at all, for reduction of the pollutant content in the exhaust gas system can be shortened further, for example, when the excitation of the at least one electrically excitable heating element is started before startup of an internal combustion engine.

When, in the method of the disclosure, the injection of hydrocarbon onto the at least one electrically excitable heating element is commenced with or after startup of the internal combustion engine, it is ensured that hydrocarbon evaporated at the at least one electrically excitable heating element is transported by the exhaust gas that is then already flowing in the exhaust gas system, for example to the oxidation catalyst block that follows downstream.

In an alternative procedure, the injection of hydrocarbon onto the at least one electrically excitable heating element can be commenced even before startup of the internal combustion engine. This procedure leads to particularly rapid and efficient heating when the oxidation catalyst material coating is provided on the at least one electrically excitable heating element and heat is therefore already released directly at the heating element thus coated by the oxidation of the heated hydrocarbon.

For efficient heating, it may be the case that:

a) before startup of the internal combustion engine, in a preinjection operation, hydrocarbon is injected in a predetermined amount or/and for a predetermined period of time, b) after the preinjection operation has ended, the internal combustion engine is driven to rotate without ignition, c) before startup of the internal combustion engine, in a last preinjection operation, hydrocarbon is injected in a predetermined amount or/and for a predetermined period of time.

Intermediate rotation of the internal combustion engine, that is, movement of the crankshaft and the pistons thereof without generation of ignition in the cylinders, has the effect that air and hence oxygen is transported into the exhaust gas system, in order to provide oxygen for the oxidation of the hydrocarbon in a further preinjection operation that then follows.

Performance of measure c) may be preceded by at least one repetition of measures a) and b). Since the last preinjection operation is performed with measure c), the internal combustion engine can be put into operation after or during the performance of measure c).

If multiple repetition of such preinjection operations has already led to sufficient heating of the exhaust gas system, the injection of hydrocarbon can be ended with the ending of measure c). For example, in the case of comparatively low ambient temperatures and with a correspondingly cold exhaust gas system, it may be advantageous for sufficient and rapid heating of the exhaust gas system when the injection of hydrocarbon is restarted or continued after measure c) has ended and after the internal combustion engine has been started up. This means that, for example, with the ending of measure c), the injection of hydrocarbon with the internal combustion engine then in operation can be continued uninterrupted, or that, after measure c) has ended, the injection of hydrocarbon is interrupted briefly and then, when it is established that, for example, various system regions of the exhaust gas system are still sufficiently heated, injection of hydrocarbon and catalytic oxidation thereof to release heat is recommenced.

In order to ensure that the hydrocarbon injected can be converted essentially completely over the oxidation catalyst arrangement for release of heat, the hydrocarbon injection rate can be determined depending on a temperature of the oxidation catalyst arrangement or/and depending on an exhaust gas volume flow rate in the exhaust gas system. The higher the temperature of the oxidation catalyst arrangement, the more efficiently it can convert the hydrocarbon, such that it is possible with increasing temperature of the oxidation catalyst arrangement also to increase the amount of energy released per unit time by increasing the hydrocarbon injection rate. A higher exhaust gas volume flow rate means a higher flow rate and correspondingly also a shorter dwell time or else a lower probability that evaporated hydrocarbon transported in the exhaust gas stream will meet the surface of the oxidation catalyst arrangement and be oxidized there. It is therefore advantageous, with a greater exhaust gas volume flow rate, to reduce the amount of hydrocarbon injected per unit time in order to avoid emission of nonoxidized hydrocarbon. For example, such parameters as the temperature of the oxidation catalyst arrangement, for example including in different regions thereof, and the exhaust gas volume flow rate in a map that defines the hydrocarbon injection rate may be taken into account as input parameters.

It may especially be the case here that the hydrocarbon injection rate increases with increasing temperature of the oxidation catalyst arrangement or/and in that the hydrocarbon injection rate decreases with increasing exhaust gas volume flow rate.

BRIEF DESCRIPTION OF DRAWINGS

The invention will now be described with reference to the drawings wherein.

DETAILED DESCRIPTION

Figure 1:
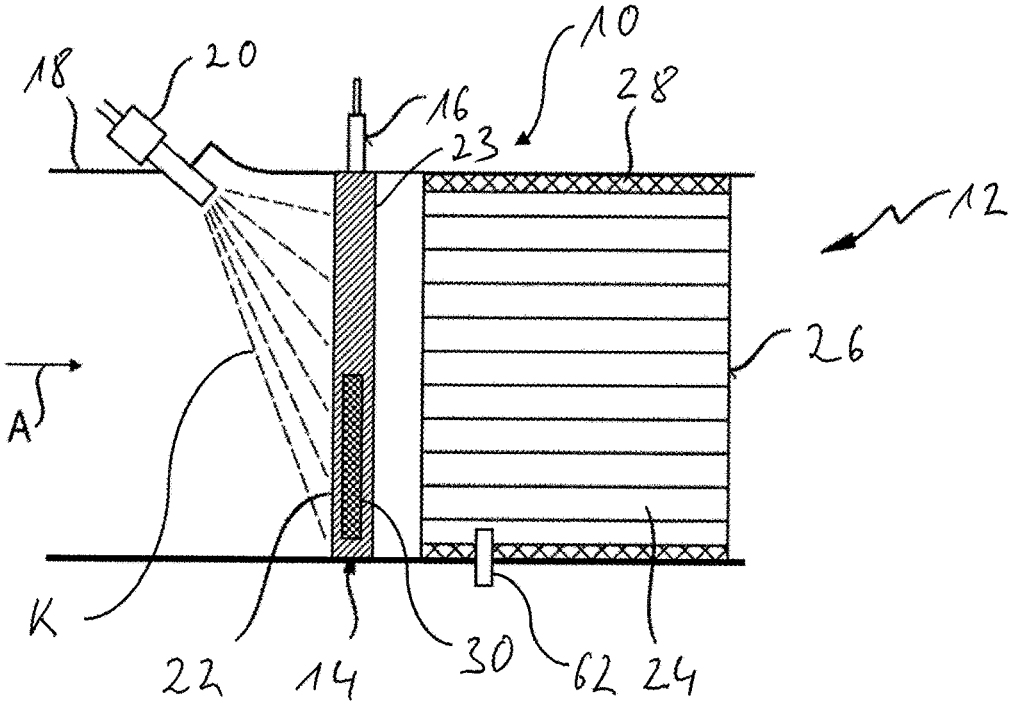
FIG. 1 shows a longitudinal section view of a catalytic heater for an exhaust gas system of an internal combustion engine.

FIG. 1 shows, in a basic longitudinal section, a catalytic heater generally labelled 10 in an exhaust gas system 12 for an internal combustion engine.

The catalytic heater 10 includes, as an essential constituent, an electrically excitable heating element 14 which can be connected via contacts 16 to a voltage source, for example an onboard voltage system of a vehicle. The electrically excitable heating element 14 may take the form of a heat conductor made of two-dimensional material in strip form, of a jacket heater or the like, and may be in a wound arrangement, for example, with a spiral winding structure, meandering winding structure or some other arrangement, such that exhaust gas A flowing toward a pipelike exhaust gas guiding component 18, for example, can flow around the heating element 14 therein and absorb heat as it does so. Upstream of the heating element 14 is positioned a hydrocarbon release arrangement 20, generally also referred to as injector. This releases liquid hydrocarbon K, for example diesel or gasoline, for example in spray form or in droplet form, in the direction toward an inflow side 22 of the electrically excitable heating element 14.

An oxidation catalyst block 24 of an oxidation catalyst arrangement generally labelled 26, on an outflow side 23 of the heating element 14, is supported, for example, by a fiber mat 28 or the like in the exhaust gas guiding component 18. The oxidation catalyst block 24 is constructed, for example, with a substrate through which exhaust gas A can flow, which has oxidation catalyst material on its surface. Depending on the type of internal combustion engine used in conjunction with the exhaust gas system 12, this oxidation catalyst material may be diesel oxidation catalyst material in the case of a diesel engine or three-way catalytic converter material in the case of a gasoline engine.

The oxidation catalyst arrangement 26 optionally includes an oxidation catalyst material coating 30 on the electrically excitable heating element 14. This may cover the surface of the electrically excitable heating element essentially completely or else only partly and, depending on the type of internal combustion engine and hence the type of hydrocarbon K used, for example, may likewise include diesel oxidation catalyst material or three-way catalytic converter material.

The hydrocarbon release arrangement 20 used in the catalytic heater 10 may include, for example, an injector that releases the hydrocarbon K symmetrically, that is, in the form of a uniform spray cone, or may include an injector that releases the released hydrocarbon K asymmetrically, that is, mainly to one side. As an alternative to the inclined positioning with regard to the exhaust gas flow direction in an exhaust gas guiding component 18 that extends in an essentially linear manner, as apparent in FIG. 1, it would also be possible for the hydrocarbon release arrangement 20 to be positioned in an arc region of the exhaust gas guiding component 18 positioned upstream of the heating element 14, such that the main release direction of the hydrocarbon release arrangement 20 corresponds essentially to the flow direction of the exhaust gas A immediately upstream of the heating element 14. It is thus possible to achieve a compact configuration of the catalytic heater 10 or of an exhaust gas system 12 constructed therewith.

Figure 2:
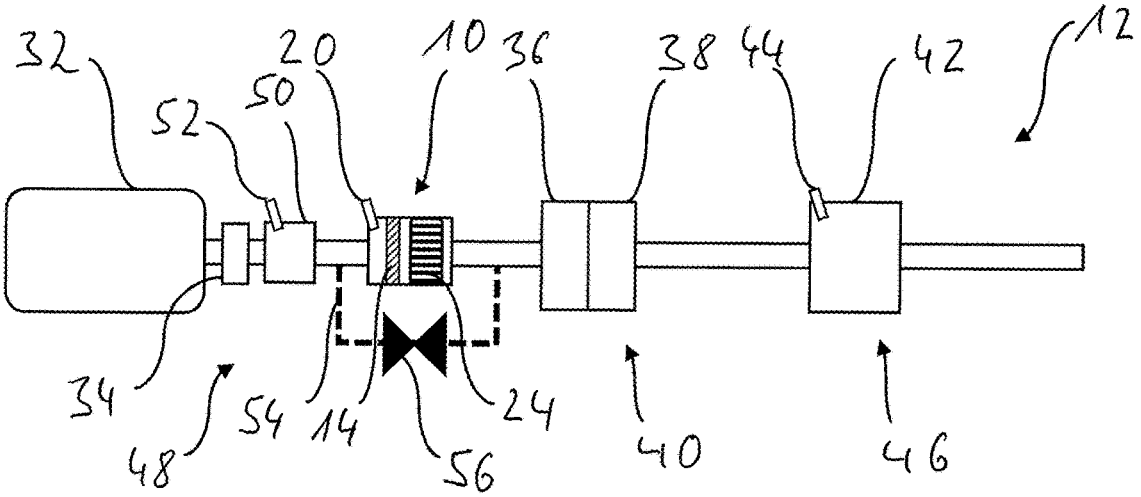
FIG. 2 is a basic diagram of an exhaust gas system that accepts the exhaust gas emitted by an internal combustion engine.

FIG. 2 illustrates the exhaust gas system 12 used in conjunction with an internal combustion engine 32. Upstream of the catalytic heater 10, an exhaust gas turbocharger 34 is provided in the exhaust gas system 12. Downstream of the catalytic heater 10 are provided a first exhaust gas treatment assembly 40 including, for example, a diesel oxidation catalyst 36 and a particulate filter 38, and a second exhaust gas treatment assembly 46 including, for example, an SCR catalyst 42 with an assigned injector 44. Such a configuration of the two exhaust gas treatment assemblies 40, 46 is envisaged in particular in conjunction with an internal combustion engine 32 in the form of a diesel engine.

When the oxidation catalyst block 24 of the catalytic heater 10 is of sufficiently large dimensions, it would be possible, for example, to dispense with the diesel oxidation catalyst 36 of the first exhaust gas treatment assembly 40. Moreover, a third exhaust gas treatment assembly 48 may optionally be provided upstream of the catalytic heater 10 or downstream of the exhaust gas turbocharger 34, which may include, for example, a pre-SCR catalyst 50 with an assigned injector 52.

FIG. 2 also shows that a bypass flow pathway 54 assigned to and parallel to the catalytic heater 10 may advantageously be provided, which can electively be opened to flow or blocked against flow by a valve 56 assigned thereto. In a state in which operation of the catalytic heater 10 is not required, the bypass flow pathway 54 can be opened to flow, such that an elevated flow resistance introduced by the catalytic heater 10 can be compensated for. In the case of a bypass flow pathway 54 opened to flow, for example, a majority of the exhaust gas A released by the internal combustion engine 32 can flow through it.

In heating operation of the catalytic heater 10, the bypass flow pathway 54 is blocked by the valve 56, such that the entire exhaust gas stream is passed through the catalytic heater 10 and hence heat can be transferred from the catalytic heater 10 to system regions that follow downstream. It may also be the case here that, when heating operation of the catalytic heater 10 sets in approximately simultaneously with commencement of operation of the internal combustion engine 32, the valve 56 is opened, such that a majority of the exhaust gas A emitted by the internal combustion engine 32 flows through the bypass flow pathway 54 in a heating phase of the heating element 14. As a result, only a comparatively small portion of the heat generated by excitation of the heating element 14 is removed by the exhaust gas A flowing around the heating element 14, which results in faster heating of the heating element 14 and hence also fast attainment of a state in which the hydrocarbon K is evaporated at the surface of the heating element 14.

Figure 3:
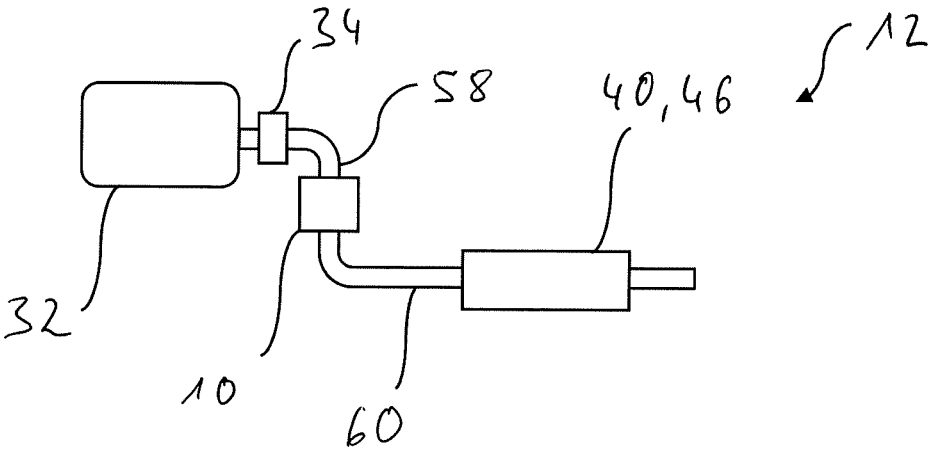
FIG. 3 is a further basic diagram of an exhaust gas system.
Figure 4:
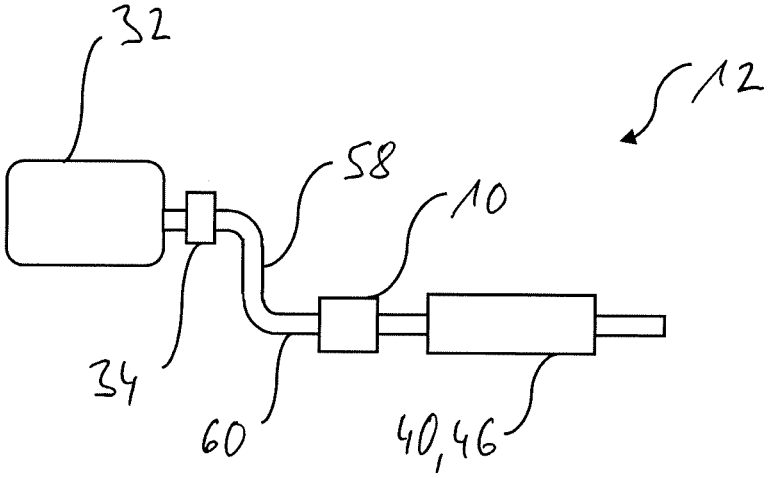
FIG. 4 is a further basic diagram of an exhaust gas system.

FIGS. 3 and 4 illustrate various arrangement options for the catalytic heater 10 in the exhaust gas system 12. The exhaust gas system 12 may in principle be constructed such that it has an exhaust gas system section 58, generally referred to as a downpipe, which is connected to the internal combustion engine 32 or the exhaust gas turbocharger 34 and which leads away from the internal combustion engine 32, for example in the downward or/and lateral direction. This exhaust gas system section 58 that leads downward or/and to the side may be connected to a section 60 of the exhaust gas system that extends, for example, beneath the underbody of a vehicle. It is also possible for the section 58 to lead to exhaust gas treatment assemblies positioned in a lateral region, for example of a truck.

In the working example shown in FIG. 3, the catalytic heater 10 is positioned in the section 58 of the exhaust gas system 12 that extends downward or/and laterally with regard to the internal combustion engine 32. This build space is thus exploited efficiently. The catalytic heater 10 is thus positioned very close to the internal combustion engine 32, such that the exhaust gas A that flows through it and is additionally heated in the manner described below can contribute efficiently to heating of exhaust gas treatment assemblies positioned further downstream.

In an alternative configuration, for example when no build space is available therefor, the catalytic heater 10 is positioned not in the section 58 of the exhaust gas system 12 that leads downward or to the side, but rather in the section 60 of the exhaust gas system 12 positioned, for example, beneath the underbody of a vehicle or in a lateral region of a vehicle.

It should be pointed out that any configuration variants of the exhaust gas system 12 that are shown in FIGS. 3 and 4 may be provided in conjunction with the various further system regions that are also shown in detail in FIG. 2, that is, the various exhaust gas treatment assemblies 40, 46, 48 or/and also the bypass flow pathway 54.

There follows an elucidation of the operation of the catalytic heater 10 in the exhaust gas system 12 for accelerated heating of the system regions that follow in the exhaust gas flow pathway, that is, the exhaust gas treatment assemblies 40, 46 in particular.

In operation of the catalytic heater 10, the excitation of the heating element 14, that is, by application of an electrical voltage thereto, and the heat generated at the heating element 14 result in evaporation and heating of the hydrocarbon K that meets the heating element 14 in liquid form. At the same time, heat is transferred primarily by thermal radiation to the upstream end region of the oxidation catalyst block 24, and this is heated even when the exhaust gas stream does not yet exist. The temperature of the oxidation catalyst block 24 in the upstream end region thereof can be detected by a temperature sensor 62 and be utilized in an actuation unit that actuates the catalytic heater 10 in order to actuate and to operate the catalytic heater 10 and any further system regions of the exhaust gas system 12 depending on that temperature.

The hydrocarbon K heated and evaporated at the heating element 14, in the manner described in detail hereinafter, is carried onward in the direction of the oxidation catalyst block 24 and can be oxidized at the surface thereof with oxygen which is also present in the exhaust gas system 12. This catalytic oxidation reaction releases heat, which contributes to further heating of the oxidation catalyst block 24 and hence also to heating of the exhaust gas A that flows through it in operation of the internal combustion engine 32. The exhaust gas A transports the heat absorbed in the catalytic heater 10 in the downstream direction toward the exhaust gas treatment assemblies 40, 46 that then follow and transfers at least some of the heat thereto. This means that the exhaust gas treatment assemblies 40, 46 are heated more quickly, especially in the initial phase of working operation of the internal combustion engine 32, such that any catalytic reactions that have to be conducted therein can set in at an earlier stage, and hence the duration over which exhaust gas A is emitted essentially untreated is distinctly shortened.

If the oxidation catalyst material coating 30 is additionally also provided on the heating element 14, it is possible for at least a portion of the hydrocarbon K that meets the heating element 14 and is evaporated thereby to be oxidized in a catalytic reaction as early as at the heating element 14. This also releases heat, which firstly contributes to faster and more intense heating of the heating element 14, and secondly additionally also to faster heating of the oxidation catalyst block 24 or of the exhaust gas A flowing within the exhaust gas system 12.

Since, with such a catalytic heater 10, the exhaust gas or system regions of the exhaust gas system 12 that follow downstream are not only heated via the heat generated by electrical excitation of the heating element 14, but a significant portion of the thermal energy released in the region of the catalytic heater 10 is provided by the catalytic oxidation reaction of the hydrocarbon K, it is possible to achieve significantly more intense and faster heating of the various system regions of the exhaust gas system 12 with distinctly reduced use of electrical energy. This permits, for example, operation of the heating element 14 with a lower operating voltage, for example a voltage of 24 V provided in an onboard power grid.

There follows a description of various modes of operation of the exhaust gas system 12 or of the catalytic heater 10, with which efficient heating of the system regions present for exhaust gas cleaning in the exhaust gas system 12, especially of the exhaust gas treatment assemblies 40, 46, can be ensured.

On startup of a vehicle or the internal combustion engine 32, it is also possible to commence excitation of the heating element 14, that is, to apply a voltage thereto in order to generate heat in the region thereof. Since the release of exhaust gas A also sets in with commencement of operation of the internal combustion engine 32, a portion of the heat generated in the heating element 14 is carried by the exhaust gas stream in the downstream direction to the oxidation catalyst block 24. A portion of the heat can also be transferred directly by thermal radiation from the heating element 14 to the upstream end region of the oxidation catalyst block 24.

If, for example, it is recognized from the output signal from the temperature sensor 62 that the oxidation catalyst block 24 is at a temperature sufficient for the performance of a catalytic oxidation of the hydrocarbon K at least in its upstream end region, which may be 250° C. or higher, for example, it is possible to commence the injection of liquid hydrocarbon K in the direction toward the heating element 14. The liquid hydrocarbon K is evaporated at the surface of the heated heating element 14 and transported by the exhaust gas stream in the direction toward the oxidation catalyst block 24. Oxidation of the hydrocarbon K with the oxygen present in this state in the exhaust gas system 12 or transported within the exhaust gas A then takes place over the oxidation catalyst block 24. This oxidation releases heat, which, in addition to the heat released by the excitation of the heating element 14, not only heats the exhaust gas A that then flows further in the downstream direction, but also contributes to even faster heating of the oxidation catalyst block 24, especially also in the direction toward the downstream region thereof. As a result, comparatively quickly after the onset of the oxidation reaction over the oxidation catalyst block 24, the entire oxidation catalyst block 24 is at a temperature required for performance of a catalytic oxidation of the hydrocarbon K.

In order to attain this temperature even earlier or to be able to contribute to heating of the exhaust gas A that heats system regions of the exhaust gas system 12 that are further downstream even earlier, the excitation of the heating element 14 may also be started, for example, as early as 5 to 20 seconds before startup of the internal combustion engine 32. Triggers utilized for this purpose may be events in a vehicle that suggest that the internal combustion engine 32 is highly likely to be put into operation in the foreseeable future. For example, the unlocking of the vehicle doors or the insertion of an ignition key into an ignition lock may be utilized as such events that trigger the excitation of the heating element 14.

The injection of hydrocarbon may set in, for example, when the heating element has reached a sufficiently high temperature, for example in the range from 200 to 400° C., preferably at least 350° C. This temperature can either be detected by a temperature sensor assigned to the heating element 14 or determined empirically and associated with a period of time from commencement of excitation of the heating element 14, such that the injection of hydrocarbon can be commenced for a predetermined period of time from commencement of excitation of the heating element 14. If the excitation of the heating element 14 sets in as early as before commencement of operation of the internal combustion engine 32, even faster heating of the heating element 14 to the desired temperature can be achieved because the exhaust gas stream is still absent in this phase.

If the heating element 14 has the oxidation catalyst material coating 30, it is equally possible to commence the excitation of the heating element 14 with startup of the internal combustion engine 32 or even shortly before, and to commence the injection of hydrocarbon K with startup of the internal combustion engine 32. Since, in the case of such a configuration of the heating element 14 with the oxidation catalyst material coating 30 thereon, a portion of the hydrocarbon K that has been heated and also evaporated at the heating element 14 is already oxidized at the oxidation catalyst material coating 30, the heating element 14 will heat up more quickly and a greater amount of heat will be provided, which is transferred to the oxidation catalyst block 24 by thermal radiation and convection. The exhaust gas A flowing within the exhaust gas system 12 from the start of operation of the internal combustion engine 32 can also absorb heat to an enhanced degree in the region of the heating element 14, and also transport it into the region of the system regions of the exhaust gas system 12 that follow further downstream.

The increased generation of heat in the region of the heating element 14 thus leads not only to more intense evaporation of the liquid hydrocarbon K but also to faster heating of all system regions that follow downstream, such that the oxidation catalyst block 24 more quickly reaches its maximum capacity for catalytic oxidation of hydrocarbon K, and the system regions that follow further downstream in the exhaust gas system 12 also more quickly reach their operating temperature required for the fulfillment of the respective exhaust gas cleaning function.

In a further alternative procedure, both the excitation of the heating element 14 and the injecting of the hydrocarbon K may already be effected prior to commencement of operation of the internal combustion engine 32. For example, it is first possible to excite the heating element 14 provided with the oxidation catalyst material coating 30 with the internal combustion engine 32 not yet in operation, until it reaches a target temperature in the region of at least 300° C., preferably at least 400° C. This temperature can be detected by sensors or fixed in conjunction with a period of time to be determined empirically, assuming that this temperature will be reached after a duration of 5 to 20 seconds, for example, depending on the configuration of the heating element 14. This period of time may be comparatively short since no exhaust gas is flowing within the exhaust gas system 12 in this phase.

After the desired temperature has been attained or the specified period of time has elapsed, a predetermined amount of fuel can be sprayed onto the heating element 14 or the oxidation catalyst material coating 30. The liquid hydrocarbon K is heated at the surface of the heating element 14 or of the oxidation catalyst material coating 30, optionally evaporated, and oxidized with the oxygen present in the exhaust gas system 12 in the environment of the heating element 14. In this oxidation, by comparison with the heat released by the excitation of the heating element 14, a comparatively large amount of heat is released, which leads to enhanced heating of the heating element 14 itself and also already to heating of the upstream region of the oxidation catalyst material block 24 primarily via thermal radiation. The heating element 14 in this phase can reach a temperature of 600° C. to 800° C.

Subsequently, the internal combustion engine 32 can be put into operation and the injection of hydrocarbon K can be continued, such that, with the exhaust gas stream that then likewise sets in, heat is firstly transported from the region of the heating element 14 in the downstream direction, especially also to the oxidation catalyst block 24, and evaporated hydrocarbon K is transported by the exhaust gas A flowing in the exhaust gas system 12 into the region of the oxidation catalyst block 24, in which catalytic oxidation of the evaporated hydrocarbon K can then likewise be effected at first at least over the upstream and already heated region thereof. With the startup of the internal combustion engine 32 and the onset of the exhaust gas stream, it is also possible, for example, to increase the amount of hydrocarbon K injected, since complete conversion of the hydrocarbon K is then effected not only over the oxidation catalyst material coating 30 but also or primarily over the surface of the oxidation catalyst block 24. The oxidation of the hydrocarbon K that then sets in over the oxidation catalyst block 24 leads to comparatively rapid heating of the oxidation catalyst block 24 even in the downstream end region thereof, such that the duration until attainment of the maximum oxidation capacity of the oxidation catalyst block 24 can be further shortened by the injection of hydrocarbon K that sets in even prior to startup of the internal combustion engine 32.

The injection of liquid hydrocarbon K even prior to startup of the internal combustion engine 32 can also be utilized in order to more quickly raise the temperature, especially in the region of the heating element 14 and in the upstream region of the oxidation catalyst block 24, to the desired temperature in the context of one or more pilot injections.

After the heating element 14 has been excited and heated to a temperature of at least 300° C., preferably at least 400° C., in a preinjection operation, it is firstly possible here to inject hydrocarbon K in the direction of the heated heating element 14 or the correspondingly heated oxidation catalyst material coating 30. The hydrocarbon K is heated when it meets the heating element 14 of the surface of the oxidation catalyst material coating 30, optionally evaporated, and oxidized in a catalytic reaction with the oxygen present in this region of the exhaust gas system 12. The heat that arises here contributes to more intense and faster heating of the heating element 14 or else of the upstream region of the oxidation catalyst block 24. After this preinjection operation and essentially complete catalytic oxidation of the hydrocarbon K injected have ended, the internal combustion engine 32 is driven to rotate by a starter/generator or the like without ignition in the cylinders thereof. The movement of pistons in this rotation of the crankshaft of the internal combustion engine 32 expels air and hence oxygen from the cylinders of the internal combustion engine 32 in the direction of the upstream region of the exhaust gas system 12, that is, into that region in which the catalytic heater 10 is also positioned. It is thus ensured that sufficient oxygen is available again for a further preinjection operation, in order to be able to fully oxidize the hydrocarbon K injected in this further preinjection operation.

According to the length of time available for performance of such preinjection operations, this operation of alternating injection of hydrocarbon K and rotation of the internal combustion engine 32 can be repeated several times.

The internal combustion engine 32 can then be started after a last preinjection operation has been conducted and the injection of hydrocarbon K has been ended. Alternatively, the internal combustion engine 32 may already also be started in the course of performance of the last preinjection operation. With the ending of the last preinjection operation, given already sufficient heating of the downstream system regions of the exhaust gas system 12, the injection of hydrocarbon K can be stopped. But since it can generally be assumed that pilot injections will not sufficiently heat the overall exhaust gas system 12, it may be necessary, after performance of the last preinjection operation, or optionally continuing directly thereafter, to inject hydrocarbon K and to transport the heat released in the catalytic oxidation at the oxidation catalyst block 24 or else at the oxidation catalyst material coating 30 with the exhaust gas A to the system regions to be thermally conditioned in regions that are further upstream in the exhaust gas system 12.

The extent of the rotation of the crankshaft of the internal combustion engine 32 to be conducted in the course of such pilot injections depends primarily on how many cylinders it has and how large is the volume of the cylinder. The extent of rotation should be matched to the amount of the hydrocarbon K to be injected in the course of the respective preinjection operations so as to ensure that sufficient oxygen is available for complete oxidation of the hydrocarbon K injected in the preinjection operations in the exhaust gas system 12 and especially in the environment of the heating element 14.

Events that indicate imminent commencement of operation of the internal combustion engine 32 may be utilized for the start of such pilot injections. For example, it is possible to make use of a signal that indicates opening of the vehicle doors. Alternatively or additionally, it is also possible that a vehicle user, similarly to the manner practised in connection with auxiliary heaters, defines a time for planned startup of the vehicle, such that, for example, the pilot injections can be commenced a sufficient period of time before the planned commencement of use of the vehicle, also depending on the ambient temperature and therefore also the temperature of the various system regions of the exhaust gas system 12 to be thermally conditioned. It is thus ensured that, with startup of the internal combustion engine 32, the oxidation catalyst block 24 is already heated sufficiently to be able to achieve efficient catalytic oxidation and therefore also efficient release of heat in the injection of hydrocarbon that sets in or continues with the startup of the internal combustion engine 32.

The amount of hydrocarbon to be injected on or after excitation of the heating element 14 can be adjusted depending on various parameters. Parameters that are important for the catalytic conversion of the hydrocarbon K are, for example, the temperature of the oxidation catalyst block 24 and the exhaust gas volume flow rate, that is, the amount of exhaust gas A flowing through the oxidation catalyst block 24 and carrying evaporated hydrocarbon K per unit time. The higher the temperature of the oxidation catalyst block 24, especially also in the downstream end region thereof, the more efficiently it is capable of oxidizing the hydrocarbon K that meets the surface thereof. This means that the hydrocarbon injection rate can be increased with increasing temperature of the oxidation catalyst block 24, for example up to a maximum value of the hydrocarbon injection rate. A greater exhaust gas volume flow rate, that is, a greater amount of exhaust gas flowing through the oxidation catalyst block 24 per unit time, has the result that the dwell time of the hydrocarbon K being transported in the exhaust gas A in the oxidation catalyst block 24 is correspondingly shorter. In order to avoid the emission of nonoxidized hydrocarbon K, it may be the case that hydrocarbon injection rate decreases, for example, down to a minimum value with increasing exhaust gas volume flow rate.

Taking account of such influencing parameters, for example the temperature of the oxidation catalyst block 24 and the exhaust gas volume flow rate, but, for example, also the exhaust gas temperature, the target temperature that the exhaust gas is to have after flowing through the oxidation catalyst block 24, the electrical heating output of the heating element 14, it is possible to define a map which, depending on such input parameters, defines the hydrocarbon injection rate such that a maximum amount of heat can be released on the one hand and emission of nonoxidized hydrocarbon K is avoided on the other hand.

It is understood that the foregoing description is that of the preferred embodiments of the invention and that various changes and modifications may be made thereto without departing from the spirit and scope of the invention as defined in the appended claims.

The invention claimed is:

1. An exhaust gas system for an internal combustion engine, the exhaust gas system comprising:

at least one exhaust gas treatment assembly;

a catalytic heater arranged downstream of said at least one exhaust gas treatment assembly with regard to an exhaust gas flow direction; said catalytic heater including:

at least one electrically excitable heating element;

a hydrocarbon release arrangement for releasing liquid hydrocarbon toward said at least one electrically excitable heating element; and, an oxidation catalyst arrangement for oxidizing the hydrocarbon heated at said at least one electrically excitable heating element;

wherein said catalytic heater is disposed in an exhaust gas system section to be positioned to run at least downward in a height direction away from an internal combustion engine.

2. The exhaust gas system of claim 1, wherein said oxidation catalyst arrangement comprises an oxidation catalyst block disposed on an outflow side of said at least one electrically excitable heating element for uptake and oxidation of hydrocarbon evaporated at said at least one electrically excitable heating element.

3. The exhaust gas system of claim 1, wherein said oxidation catalyst arrangement comprises an oxidation catalyst material coating of said at least one electrically excitable heating element.

4. The exhaust gas system of claim 1, wherein said at least one exhaust gas treatment assembly comprises a first exhaust gas treatment assembly having at least one of the following: i) an oxidation catalyst; and, ii) a particulate filter.

5. The exhaust gas system of claim 1, wherein said at least one exhaust gas treatment assembly comprises a second exhaust gas treatment assembly having an SCR catalyst.

6. The exhaust gas system of claim 5, wherein said first exhaust gas treatment assembly is disposed upstream with respect to said second exhaust gas treatment assembly in the exhaust gas flow direction.

7. The exhaust gas system of claim 1, wherein said catalytic heater is disposed downstream of at least one of the following: i) an exhaust gas turbocharger; and, ii) a third exhaust gas treatment assembly in the exhaust gas flow direction.

8. The exhaust gas system of claim 7, wherein said third exhaust gas treatment assembly comprises an SCR catalyst.

9. The exhaust gas system of claim 1, further comprising: an electively blockable bypass flow pathway arranged parallel to said catalytic heater.

10. The exhaust gas system of claim 9, wherein the electively blockable bypass flow pathway only bypasses the catalytic heater.

11. The exhaust gas system of claim 1, wherein the exhaust gas system section in which the catalytic heater is disposed to be positioned to run at least downward in the height direction and to run laterally away from the internal combustion engine.

12. The exhaust gas system of claim 1, wherein the hydrocarbon release arrangement is positioned in an arc region of an exhaust gas guiding component positioned upstream of the heating element.

13. A method of operating an exhaust gas system including: at least one exhaust gas treatment assembly; a catalytic heater arranged downstream of said at least one exhaust gas treatment assembly with regard to an exhaust gas flow direction; said catalytic heater including: at least one electrically excitable heating element; a hydrocarbon release arrangement for releasing liquid hydrocarbon toward said at least one electrically excitable heating element; and, an oxidation catalyst arrangement for oxidizing the hydrocarbon heated at said at least one electrically excitable heating element; the method comprising the step of:

operating the at least one electrically excitable heating element of the catalytic heater such that liquid hydrocarbon meets a surface of the at least one electrically excitable heating element and is heated and is oxidized over the oxidation catalyst arrangement to generate heat, wherein the excitation of the at least one electrically excitable heating element is started before startup of an internal combustion engine, wherein the injection of hydrocarbon onto the at least one electrically excitable heating element is commenced before startup of the internal combustion engine, wherein:

a) before startup of the internal combustion engine, in a preinjection operation, hydrocarbon is injected in at least one of the following ways: i) in a predetermined amount; and, ii) for a predetermined period of time;

b) after the preinjection operation has ended, the internal combustion engine is driven to rotate without ignition; and, c) before startup of the internal combustion engine, in a last preinjection operation, hydrocarbon is injected in at least one of a following ways: i) in a predetermined amount; and, ii) for a predetermined period of time.

14. The method of claim 13, wherein the injection of hydrocarbon toward the at least one electrically excitable heating element is started when at least one of the following applies:

i) after commencement of the excitation of the at least one electrically excitable heating element, the oxidation catalyst arrangement has a predetermined temperature that permits catalytic oxidation of hydrocarbon over the oxidation catalyst arrangement; and, ii) after a predetermined period of time has passed since commencement of the excitation of the at least one electrically excitable heating element.

15. The method of claim 13, wherein the performance of measure c) is preceded by at least one repetition of measures a) and b) or, after or during the performance of measure c), the internal combustion engine is put into operation.

16. The method of claim 15, wherein:

the injection of hydrocarbon is ended with the ending of measure c); or, the injection of hydrocarbon is restarted or continued after measure c) has ended and after the internal combustion engine has been started up.

17. The method of claim 13, wherein, after the internal combustion engine has been started up, the hydrocarbon injection rate is determined depending on at least one of the following: i) a temperature of the oxidation catalyst arrangement; and, ii) an exhaust gas volume flow rate in the exhaust gas system.

18. The method of claim 17, wherein at least one of the following applies:

i) the hydrocarbon injection rate increases with increasing temperature of the oxidation catalyst arrangement; and, ii) the hydrocarbon injection rate decreases with increasing exhaust gas volume flow rate.

19. A method of operating an exhaust gas system including: at least one exhaust gas treatment assembly; a catalytic heater arranged downstream of said at least one exhaust gas treatment assembly with regard to an exhaust gas flow direction; said catalytic heater including: at least one electrically excitable heating element; a hydrocarbon release arrangement for releasing liquid hydrocarbon toward said at least one electrically excitable heating element; and, an oxidation catalyst arrangement for oxidizing the hydrocarbon heated at said at least one electrically excitable heating element; the method comprising the step of:

operating the at least one electrically excitable heating element of the catalytic heater such that liquid hydrocarbon meets a surface of the at least one electrically excitable heating element and is heated and is oxidized over the oxidation catalyst arrangement to generate heat, wherein, after the internal combustion engine has been started up, the hydrocarbon injection rate is determined depending on at least one of the following: i) a temperature of the oxidation catalyst arrangement; and, ii) an exhaust gas volume flow rate in the exhaust gas system, wherein at least one of the following applies:

i) the hydrocarbon injection rate increases with increasing temperature of the oxidation catalyst arrangement; and, ii) the hydrocarbon injection rate decreases with increasing exhaust gas volume flow rate.

20. The method of claim 19, wherein the excitation of the at least one electrically excitable heating element is started before startup of an internal combustion engine.

21. The method of claim 20, wherein the injection of hydrocarbon onto the at least one electrically excitable heating element is commenced with or after startup of the internal combustion engine.

* * * * *